United States Patent [19]

Ward

[11] Patent Number: 4,673,613

[45] Date of Patent: Jun. 16, 1987

[54] LAMINATE MATERIAL COMPRISING POLYURETHANE AND METAL MESH

[75] Inventor: Noel D. Ward, Buff Point, Australia

[73] Assignee: Vickers Xatal Pty. Ltd., New South Wales, Australia

[21] Appl. No.: 790,230

[22] Filed: Oct. 22, 1985

[30] Foreign Application Priority Data

Mar. 21, 1985 [AU] Australia ..... PG9845/85

[51] Int. Cl.[4] ..... B32B 3/10; B32B 15/02; B32B 27/40

[52] U.S. Cl. ..... 428/247; 264/271.1; 264/273; 428/256; 428/425.8

[58] Field of Search ..... 428/309.9, 316.6, 425.8, 428/247, 251, 255, 256; 5/471; 264/271.1, 273

[56] References Cited

U.S. PATENT DOCUMENTS

| | | | |
|---|---|---|---|
| 3,188,302 | 6/1965 | Lorenz | 521/159 |
| 3,644,168 | 2/1972 | Bonk et al. | 428/258 |
| 3,647,608 | 3/1972 | Enlow et al. | 428/317.9 |
| 4,061,815 | 12/1977 | Poole, Jr. | 428/425.8 |
| 4,266,042 | 5/1981 | Park | 521/123 |
| 4,347,276 | 8/1982 | Weber et al. | 428/309.9 |
| 4,379,103 | 4/1983 | Doerfling | 264/45.5 |

*Primary Examiner*—William J. Van Balen

*Attorney, Agent, or Firm*—Birch, Stewart, Kolasch & Birch

[57] ABSTRACT

A laminate article including a moulded support member formed from a thermosetting polymeric composition including an effective amount of a polyurethane, a plasticiser for the polyurethane resin, and a polyurethane curing agent, a reinforcing member fully embedded within the moulded support member.

12 Claims, No Drawings

LAMINATE MATERIAL COMPRISING POLYURETHANE AND METAL MESH

The present invention relates to a laminate article particularly a laminate article which may be used as a base or back support covering for a seat, chair, bench or the like or as a covering for such a base or back support.

Numerous materials are known in the art for use as coverings for seats, chairs, benches and the like. However, for application where the chairs or benches will be utilised by the public eg. in public transport applications such as trams, trains and buses, the requirements for the coverings for such seats are substantially more stringent. For example, rail transport authorities require such coverings to be resistant to staining, moisture and fungal growth. They should be flame retardant, hard wearing and resistant to vandal attack.

Whilst products of the prior art may to a greater or lesser extent fulfil some of the requirements specified above, vandal attack remains a serious problem for public authorities. It would therefore be a substantial advance in the art if an article could be produced which provided an improved resistance to vandal attack.

In particular, a product with an increased resistance to slashing or puncture and a resistance to any attempt to insert or conceal sharp or pointed objects such as razor blades, pins and the like which would come in contact with passengers causing damage or injury, would constitute a substantial advance in the art.

Accordingly, it is an object of the present invention to overcome, or at least alleviate, one or more of the difficulties related to the prior art.

Accordingly, in a first aspect, the present invention provides a laminate article including (a) a moulded support member formed from a thermosetting polymeric composition including an effective amount of
  (i) a polyurethane resin,
  (ii) a plasticiser, and
  (iii) a polyurethane curing agent; and (b) a reinforcing member fully embedded within the support member (a).

The support member (a) and reinforcing member (b) may be of such a form as to provide improved resistance to slashing or puncture. The support member (a) may be of such a form as to provide a memory to recover its original shape after an attempt to slash or puncture it.

The reinforcing member (b) may be of such a form as to provide a barrier against slashing and/or puncture. The reinforcing member may provide a high tensile flexible support to the support member. The reinforcing member may limit the elongation of the support member under load.

The laminate article according to the present invention may take the form of a base or back support for a bench, seat, chair or the like or a cover for same.

The laminate article according to the present invention may further include (c) a cover member overlaying the top surface of the support member (a).

The cover member (c) may be of such a form as to provide improved resistance to one or more of the following: stains, moisture and fungal growth. The cover member may provide improved flame retardance, be hard wearing and/or provide improved resistance to other forms of vandal attack.

As described above, the laminate article according to the present invention includes a support member (a). The support member (a) may include a top face, a pair of opposed side faces, and a bottom face.

The moulded support member (a) may be of regular shape. The support member (a) may be in the form of a sheet. The support member may be of box-like shape. The top face of the support member may be contoured to support, in use, the body of a user.

The moulded support member (a) is formed, as stated above, from a thermosetting polymeric composition including an effective amount of (i) a polyurethane resin,
(ii) a plasticiser, and
(iii) a polyurethane curing agent.

The polyurethane resin together with a plasticiser may be selected to fulful at least some of the design criteria as specified below.

1. The urethane is to be impervious as opposed to a foam.
2. Material to offer a high resistance to slashing or puncture, and provide a memory to recover from such attack.
3. Provide a flexibility factor to achieve shape and comfort.
4. Have a fire retardancy to meet requirement of relevant authorities.
5. Provide a surface for accepting the adhesive for securing the fabric. The glue line to have a strength in excess of the fabric.
6. The material to have a high tensile and tear strength.
7. Provide resistance to heat, oil, solvent and a broad range of chemicals.
8. The material should preferably resist any attempt to accept or conceal sharp or pointed objects such as razor blades, pins, etc. which would come in contact with passengers causing damage or injury. The objects being exposed when the material is compressed.

A polyurethane resin which has been found to be suitable is one sold under the trade designation V8080 and available from Uniroyal Australia Pty. Ltd., Sydney, New South Wales. However, any similar polyurethane resin may be used.

The plasticiser component may be selected to improve the flexibility factor and/or puncture resistance of the support member. A wax-type plasticiser may be used. A chlorinated wax may be used. A chlorinated wax sold under the trade designation "Cereclor" and available from ICI Australia Pty. Ltd., Sydney, New South Wales has been found to be suitable. The plasticiser may be included in amounts of from approximately 1 to 2% by weight based on the total weight of polyurethane resin. Approximately 2% by weight of plasticiser is preferred.

As specified above the thermosetting polymeric composition according to this aspect of the present invention further includes (c) a polyurethane curing agent.

Any known curing agent for polyurethane resins may be used. A 4,4'-methylene-bis(2-chloroaniline) may be used. A curing agent sold under the trade designation Moca and available from Uniroyal Australia Pty. Ltd., Sydney, New South Wales has been found to be suitable. The polyurethane curing agent (c) may be added in an amount sufficient to provide the required high tensile and tear strength but with sufficient flexibility remaining in the product to achieve the desired shape and comfort for the user. The polyurethane curing agent may be added in amounts of approximately 7% to 13%, preferably 7.5% by weight to 12.5% by weight based on the total weight of the polyurethane resin. Approximately 10% by weight is preferred.

The polymeric material may include standard compounding ingredients known per se in the art. For example, compounding ingredients such as colouring agents, fillers, extenders, plasticisers, and the like may be included.

As described above the support member (a) is reinforced utilising a reinforcing member (b) embedded therewithin. The reinforcing member may take the form of a web. The reinforcing member (b) may take the form of a mesh. The mesh may be a wire mesh. The wire mesh may be of the interlocking type. The wire mesh may be of the chain-mail type. A wire mesh of the type utilised in bedding mattress applications may be used.

The reinforcing member (b) may be of less width than the support member (a). Preferably, the reinforcing member (b) is of slightly less width than the support member (a). For example, where the support member is of a width of approximately one centimeter, the reinforcing member may be of approximately 0.75 centimeters in width. The reinforcing member (b) may be positioned generally centrally of the support member (a). The reinforcing member (b) may be embedded within the support member (a) by positioning the reinforcing member within a mould prior to the formation of the support member, as described below.

The reinforcing member may be formed of any suitable material, a metal material is preferred. A steel wire material may be used in the preparation of the reinforcing member. A high density mechanical spring wire steel is preferred.

It will be understood that the combination of the support member (a) and reinforcing member (b) provides a substantial advance over the prior art. The reinforcing member provides a barrier against vandal attack in the form of slashing and the like and also provides a high tensile flexible support to the plastic. The reinforcing member limits elongation of the plastic and is of sufficient strength to achieve the load requirements for the end use of the article.

The cover member (c) of the laminate article according to the present invention, as described above, may be a fabric or sheet of a synthetic or natural material. A plastics material may be used. A vinyl plastic may be used. The fabric may be a woven fabric. A natural material may be used. A woollen fabric is preferred. The fabric may be treated to provide stain resistance, moisture resistance, resistance to fungal growth and flame retardance. The selection of a woollen fabric provides a fabric which is hard-wearing and resistant to vandal attack. A pure new wool yarn may be used. The wool yarn may be prepared utilising top quality fleece wools. The yarn may be within the micron range of approximately 29–31. The yarn may be treated prior to weaving with potassium fluor-zirconate or the like.

The wool yarn may be woven utilising a 2 ply warp spun on a worsted system and weft on a dref system. The fabric may be treated with a heat set surface coating to facilitate ease of stain removal. The underside of the fabric may be coated with a flame retardant copolymer. The copolymer may be applied as a foam.

The cover member (c) may be attached to the support member (b). Alternatively the cover member (c) may enclose the support member (b). Where the cover member is attached to the support member it may be attached to the top face, the bottom face, or two or more side faces thereof. The cover member may be attached to the support member utilising an adhesive. Desirably the cover member adhered to the top surface of the support member. Any suitable adhesive may A polymethane adhesive. Preferably the glue line so formed has an adhesive strength in excess of the tensile strength of the fabric.

In a further aspect of the present invention there is provided a method of preparing a laminate article as described above which method includes (a) providing
  (1) a thermosetting polymeric composition including an effective amount of
    (a) a polyurethane resin,
    (b) a plasticiser, and
    (c) a polyurethane curing agent
  (2) a reinforcing member as described above, and
  (3) a mould for the thermosetting polymeric composition
(b) inserting the reinforcing member into the mould,
(c) mixing the components of the thermosetting polymeric composition together and adding the mixture so formed to the mould, and
(d) curing the product of step (c) at an elevated temperature.

The method as described above may include the further steps of (b') heating the polyurethane resin and plasticiser to an elevated temperature prior to mixing of the components. The polyurethane resin and plasticiser may be heated in a suitable oven to a temperature of approximately 100° C.

The mould for the thermosetting polymeric composition may be treated prior to addition of the components with a polymer release agent. A silicon release agent may be applied to its internal surface.

The curing step (d) may be conducted at a temperature of aproximately 100° C. Desirably curing is continued for approximately two hours after which the laminate article may be removed from the mould. The curing may then continue for approximately 8 hours to obtain full hardness. The thermosetting polymeric composition should preferably be placed within a closed mould to minimise foaming.

In a further preferred aspect the method of preparing the laminate article further comprises (f) providing
  (1) a cover member for the moulded support member, and
  (2) an adhesive for the cover member (c),
(g) applying the adhesive to the under surface of the cover member and the top surface of the cured article, and
(h) contacting the coated surfaces for a period sufficient to allow the adhesive to set.

The contact step (h) may be conducted at elevated temperature for a period of approximately 8 hours.

The invention will now be more fully described with reference to the accompanying example. It should be understood, however, that the description following is illustrative only and should not be taken in any way as a restriction of the generality of the invention described above.

EXAMPLE

Ingredients: Polyurethane, Moca, Cereclor.

Polyurethane (V8080) and Moca purchased from Uniroyal Australia with Cereclor being purchased from ICI. Handling: The polyurethane polymer is supplied in 204 kilo drums or 25 kilo pales. The polymer sometimes solidifies because of temperatures below 20° C. and to overcome this the polymer must be placed in an oven at approximately 30° C. to be kept in fluid state, any temperatures in excess of this will cause the material to break down. This oven is called a holding oven.

The Moca is supplied in granulated form in 60 kilo pales and should be kept free from moisture and dirt.

Cereclor is supplied in 44 gallon drums and is ready for use.

Production Method

A predetermined amount of polymer is weighed out and placed in another oven at a temperature of 100° C. and when the polymer reaches 100° C. it is placed into a degassing chamber, a vacuum is applied to remove any air trapped in the polymer, and it is then returned to the same oven.

The Moca is then weighed out at 10 parts per hundered of the polymer, and placed into an oven at a temperature of 115° C. until the granules melt.

The mould is prepared and a silicon release agent applied. The wire mattress mesh is cut to size and placed in position in the mould.

The wire has the following specification: 23 Gauge H.D. mechanical spring wire galvanised DK1068.

Carbon: 0.67 to 0.7
Phosphorous: 0.04 max
Manganese: 0.6 to 0.8
Silicon: 0.15
Sulphur: 0.04 max The polymer is taken from the oven and 2% of cereclor is added, if required a colouring agent can be added at this stage (Approx. 0.01%). The Moca is taken from its oven and mixed with the polymer solution, taking care not to allow any air bubbles to enter the mix.

The polyurethane solution has a pot life of some then minutes. After the mould has been poured it is placed into an oven at a temperature of 100° C. for two hours, after which the polyurethane solution will have hardened to a stage where demoulding can take place. It is then returned to the oven for a furtehr 8 hours to obtain full hardness.

When taken from the oven after obtaining full hardness, any excess release agent is washed from the seat with M.E.K. degreasing liquid. A polyurethane solution is then prepared which is used to glue the fabric to the seat. It is applied with a brush, the fabric being pre-cut is put onto the seat, any air entrapment is worked from between the seat and the fabric by means of a small roller. The seat is then returned to the oven for a further 8 hours for the glue to set.

Finally, it is to be understood that various other modifications and/or alterations may be made without departing from the spirit of the present invention as outlined herein.

I claim:

1. A laminate article having increased resistance to puncture or slashing which comprises (a) a moulded substantially non-cellular support member formed from a thermosetting polymeric composition including an effective amount of
(i) a polyurethane resin,
(ii) a plasticiser for the polyurethane resin, and
(iii) a polyurethane curing agent, (b) a reinforcing wire mesh member fully embedded within the moulded support member (a) and having a width less than the moulded support member.

2. A laminate article according to claim 1 further including (c) a cover member overlaying the top surface of the moulded support member (a).

3. A laminate article according to claim 1 wherein the thermosetting polymeric composition includes (i) from approximately 85% by weight to approximately 92% by weight based on the total weight and thermosetting polymeric composition of the polyurethane resin,
(ii) from approximately 1 to 2% by weight based on the weight of the thermosetting plasticiser for the polyurethane resin, and
(iii) from approximately 7 to 13% by weight based on the weight of the thermosetting polymeric composition of a polyurethane curing agent.

4. A laminate article according to claim 3 wherein the plasticiser is a chlorinated wax and the polyurethane curing agent is 4,4'-methylene-bis(2-chloroaniline).

5. A laminate article according to claim 4 wherein the reinforcing member is in the form of a metal web or mesh.

6. A laminate article according to claim 5 wherein the cover member is manufactured from a woolen fabric treated to provide stain resistance, moisture resistance, resistance to fungal growth and flame retardance.

7. A method of preparing a laminate article which comprises a moulded substantially non-cellular support member formed from a thermosetting polymeric composition comprising effective amount of (i) a polyurethane resin
(ii) a plasticiser for the polyurethane resin,
(iii) a polyurethane curing agent, and a reinforcing wire mesh member fully embedded within the moulded support member and having a width slightly less than the moulded support member, which method comprises providing a thermosetting polymeric composition including an effective amount of a polyurethane resin, a plasticiser for the polyurethane resin, and a polyurethane curing agent;

a reinforcing member as described above, and a mould for the thermosetting polymeric compostion inserting the reinforcing member into the mould, mixing the components of the thermosetting polymeric composition together adding the mixture so formed to the mould, and curing the product at an elevated temperature.

8. A method of preparing a laminated article according to claim 7 which method further includes heating the polyurethane resin and plasticiser to an elevated temperature prior to mixing of the components of the thermosetting polymeric composition.

9. A method according to claim 8 wherein the mould for the thermosetting polymeric composition is treated prior to addition of the components with a polymeric release agent.

10. A method according to claim 9 wherein the curing step is conducted at a temperature of approximately 100° C. for approximately two hours within the mould.

11. A method according to claim 10 wherein the curing step is conducted in a closed mould.

12. A method of preparing a laminated article according to claim 7 which method further includes providing (1) a cover member for the moulded support member, and (2) an adhesive for the cover member, applying the adhesive to the under surface of the cover member and the top surface of the cured article, and contacting the coated surfaces for a period sufficient to allow the adhesive to set.

* * * * *